US005133089A

United States Patent [19]

Tsutsui et al.

[11] Patent Number: 5,133,089

[45] Date of Patent: Jul. 28, 1992

[54] WATER CLOSET FLUSHING APPARATUS

[75] Inventors: Osamu Tsutsui; Atsuo Makita; Hirofumi Takeuchi; Shinji Shibata; Noboru Shinbara, all of Chigasaki, Japan

[73] Assignee: Toto Ltd., Kitakyushu, Japan

[21] Appl. No.: 385,072

[22] Filed: Jul. 24, 1989

[30] Foreign Application Priority Data

Jul. 25, 1988 [JP] Japan ..... 63-185134
Jul. 25, 1988 [JP] Japan ..... 63-185136
Dec. 14, 1988 [JP] Japan ..... 63-315651

[51] Int. Cl.[5] ..... E03D 1/00; E03D 13/00

[52] U.S. Cl. ..... 4/300; 4/305; 4/313; 4/329

[58] Field of Search ..... 4/300 R, 308, 305, 313, 4/314, 324, 329, 353, 354, 361-362, 366-367, 374, 377, 408, 410, 425, DIG. 3, DIG. 15, 407, 408, 406

[56] References Cited

U.S. PATENT DOCUMENTS 1,119,812 12/1914 Deignen et al. ..... 4/425 X
1,142,092 6/1915 Haas ..... 4/425 X
1,973,349 9/1934 Kruse ..... 4/425
1,998,861 4/1935 Campus ..... 4/425
2,552,625 5/1951 Filliung, Jr. ..... 4/305 X
2,688,141 9/1954 Filliung ..... 4/305 X
2,783,475 3/1957 Sturman ..... 4/374
3,010,115 11/1961 Wiggs ..... 4/300
3,843,978 10/1974 Ragot ..... 4/425
3,965,492 6/1976 Hendricks ..... 4/425 X

*Primary Examiner*—Ernest G. Cusick
*Assistant Examiner*—David J. Walczak
*Attorney, Agent, or Firm*—Ladas & Parry

[57] ABSTRACT

In a water closet flushing apparatus of the type in which the flushing water from a flushing water supply source is fed through different flushing water feed lines to a bowl portion and a trap discharge passage defined adjacent to the bottom portion of the bowl portion, a water jet injector is provided so as to inject the flushing water jet toward the trap discharge passage, an opening-closing valve is disposed in each of different feed lines, and the operation of the opening-closing valve is controlled by a control unit. The flushing water is flushed into the bowl portion so as to clean the same while the jet of flushing water is injected into the trap discharge passage to cause the same to act as a siphon, whereby waste matter is discharged.

12 Claims, 8 Drawing Sheets

WATER CLOSET FLUSHING APPARATUS

BACKGROUND OF THE INVENTION

The present invention relates to a water closet (abbreviated to W.C. hereinafter in this specification) flushing apparatus and more particularly to a W.C. flushing apparatus capable of efficiently charging flushing water not only to a W.C. bowl but also to a trap discharge passage which is disposed in the vicinity of the bottom of the W.C. bowl and which can produce the siphon action.

A W.C. comprises a bowl which receives waste matter from the human body and a trap discharge passage substantially in the form of an inverted U and communicated with the bottom of the W.C. bowl.

In order that the trap discharge passage may produce the siphon action which is required for not only decreasing the quantity of flushing water charged into the W.C. bowl but also positively causing the discharge of fluid waste together with the flushing water, there has recently been proposed a method in which flushing water is fed through independent flushing water lines to the W.C. bowl and the trap discharge passage.

For instance, in the case of the W.C. flushing apparatus disclosed in Japanese Patent Publication No. 30092/1980, an independent flushing water pipe and a flushing water discharge line are communicated with a W.C. bowl and a trap discharge passage, respectively, thereby charging flushing water to them independently of each other. In the W.C. flushing apparatus of the type just described above, solenoid controlled valves are inserted into the flushing water pipe and the flushing water charging line, respectively and are closed or opened in response to the signal transmitted from a timer. Furthermore, a port for charging flushing water into the trap discharge passage is opened in the vicinity of the trap discharge passage.

In the W.C. flushing apparatus of the type just described above, the solenoid controlled valves are so controlled that first flushing water is charged into the trap discharge passage to produce the siphon action, whereby waste matter and flushing water are discharged. Thereafter flushing water is charged into the W.C. bowl to clean the same. Therefore as compared with the conventional W.C. flushing apparatus of the type in which flushing water is charged only into the W.C. bowl, the effect for causing the trap discharge pipe to function as a siphon requiring little flushing water so that flushing water can be saved, can be attained.

However, in the case of the conventional flushing apparatus of the type described above, the solenoid controlled valves are controlled to open or close in response to a time interval set by the timer so that there is the problem that when the pressure of the flushing water in the flushing water charging line is varied, the flow rate is also varied so that an effective flushing effect cannot be attained. In particular, there exists the problem that when the pressure of the flushing water drops, waste matter remains in the W.C. bowl.

The port for charging flushing water into the trap discharge passage is opened when the W.C. bowl is molded and is not adapted to charging flushing water as a jet stream. Therefore there exists the problem that the quantity of flushing water used to cause the trap discharge passage to act as a siphon is not decreased as expected.

Furthermore, cleaning of the W.C. bowl with flushing water is carried out after the discharge of waste matter so that there exists the problem that waste matter which was not completely discharged by the siphon action of the trap discharge passage again remains in the W.C. bowl.

In order to overcome the problems encountered in the above described W.C. flushing apparatuses, a W.C. flushing apparatus as disclosed in Japanese Patent Publication No. 42057/1986 has been proposed. With this W.C. flushing apparatus, in order to solve the problem that the quantity of flushing water varies in response to variations in the pressure of the flushing water, a flushing water storage tank for previously storing the flushing therein is provided. The inner space of the flushing water storage tank is divided into a flushing water charging line for charging the flushing water into the trap discharge passage and a flushing water charging line for charging the flushing water into the bowl. That is, a predetermined quantity of flushing water once stored in the storage tank is distributed in the storage tank and is charged.

When such flushing water storage tank is provided, the problem of an insufficient quantity of charged water due to the variations in the pressure of flushing water can be solved. However, in order to provide such a storage tank, more space and installation work are required. Moreover, there exists the problem that the construction of the flushing water storage tank is complicated so that the cost of manufacture is expensive.

A further problem of the conventional W.C. flushing apparatus of the type described above resides in the fact the flushing operation cannot be carried out until a surface level of flushing water in the storage tank reaches a predetermined level, and therefore the W.C. flushing apparatus cannot be continuously used.

In the W.C. flushing apparatus of the type described above, the flushing water charging process is so determined that flushing water is first charged into the trap discharge passage so as to produce the siphon action and then the flushing water is charged into the W.C. bowl to clean it. As a result, when the W.C. bowl is extremely contaminated, there arises the problem that the W.C. bowl cannot be satisfactorily cleaned.

In addition, since the cross sectional area of the port for charging flushing water into the trap discharge passage is large, the kinetic energy of flushing water discharged through the port is reduced so that the effect of the flushing water jet is not satisfactory. As a result, there arises the problem that the quantity of flushing water to be charged to the trap discharge passage to produce the siphon action cannot be increased sufficiently within a short period of time so that the quantity of flushing water charged through the port cannot be sufficiently decreased.

SUMMARY OF THE INVENTION

The present invention was made to overcome the above and other problems encountered in the conventional W.C. flushing apparatus and an object of providing a W.C. flushing apparatus capable of effectively cleaning a W.C. bowl with a little quantity of flushing water.

A W.C. flushing apparatus in accordance with the present invention comprises a bowl portion provided with a flushing water inlet port; a trap discharge passage defined in the vicinity of the bottom of the bowl portion; a flushing water supply source; bowl portion communication means in which is defined a passage communicating the flushing water inlet port of the bowl portion with the flushing water supply source; a water jet injection means for injecting the flushing water toward the trap discharge passage; a water-jet-injection-unit communicating means in which is defined a passage for communicating the water jet injection means with the flushing water supply source; an opening or closing means which is disposed in the passage in the bowl portion communication means and opens or closes the passage; a means disposed within the passage in the water jet injection communication means so as to open and close the passage; and a control means for delivering the "OPEN" and/or "CLOSE" signals to the means for opening or closing the flow passage in communication with the bowl portion and the means for opening or closing the flow passage in communication with the water jet injection means.

According to the present invention, the flushing water is charged into the bowl portion and the trap discharge passage in the following steps.

a. A predetermined quantity of flushing water is charged into the bowl portion, thereby cleaning it;
b. A flushing water jet is injected into the trap discharge passage so as to cause the trap passage discharge passage to act as a siphon, thereby discharging the water within the bowl portion;
c. The flushing water is charged at a predetermined flow rate to the bowl portion, thereby providing a water seal for the bowl portion.

According to a preferred embodiment of the present invention, disposed within the bowl portion communication means and the water jet injection unit communication means are flow rate detection means in order to detect the flow rates of the flushing water flowing through the above-mentioned two communication means, respectively.

The control means is provided with a flushing water quantity accumulation means for accumulating the quantity of the flushing water in response to the signals representing the flow rates in the above-mentioned two flow rate detection means, and a comparator means for comparing the quantity of the flushing water integrated by the integration means with a predetermined flushing water charging quantity.

According to another embodiment of the present invention, the water jet injection means is provided with a flushing water jet injection nozzle.

BRIEF DESCRIPTION OF THE ACCOMPANYING DRAWINGS

Figure 8:
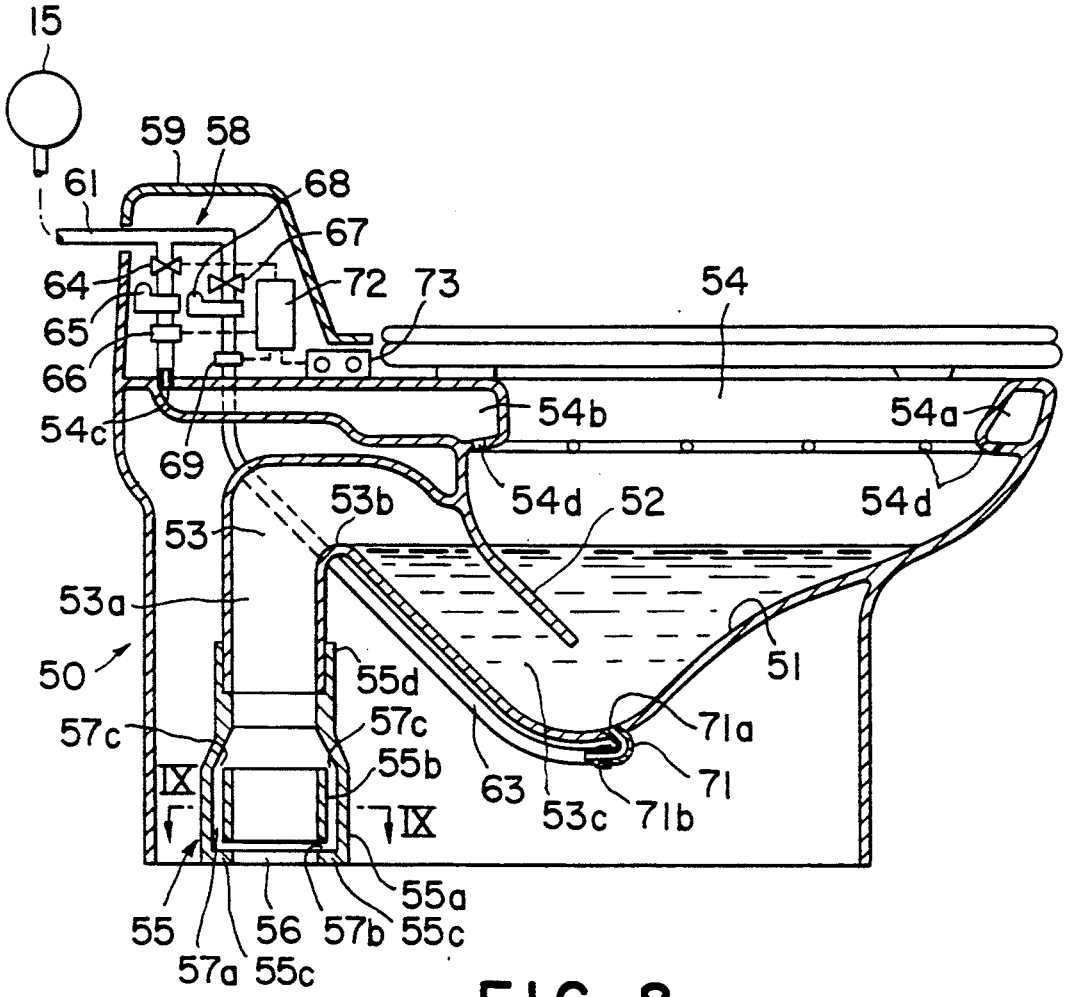
FIG. 8 is a longitudinal sectional view illustrating a third preferred embodiment of a W.C. flushing apparatus in accordance with the present invention.
Figure 9:
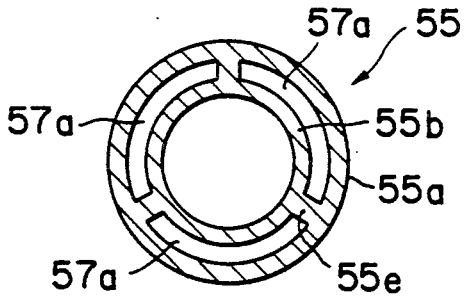
FIG. 9 is a sectional view taken along the line IX—IX of FIG. 8.

The same reference numerals are used to designate similar parts throughout the figures except FIGS. 8 and 9.

DESCRIPTION OF THE PREFERRED EMBODIMENTS

Figure 1:
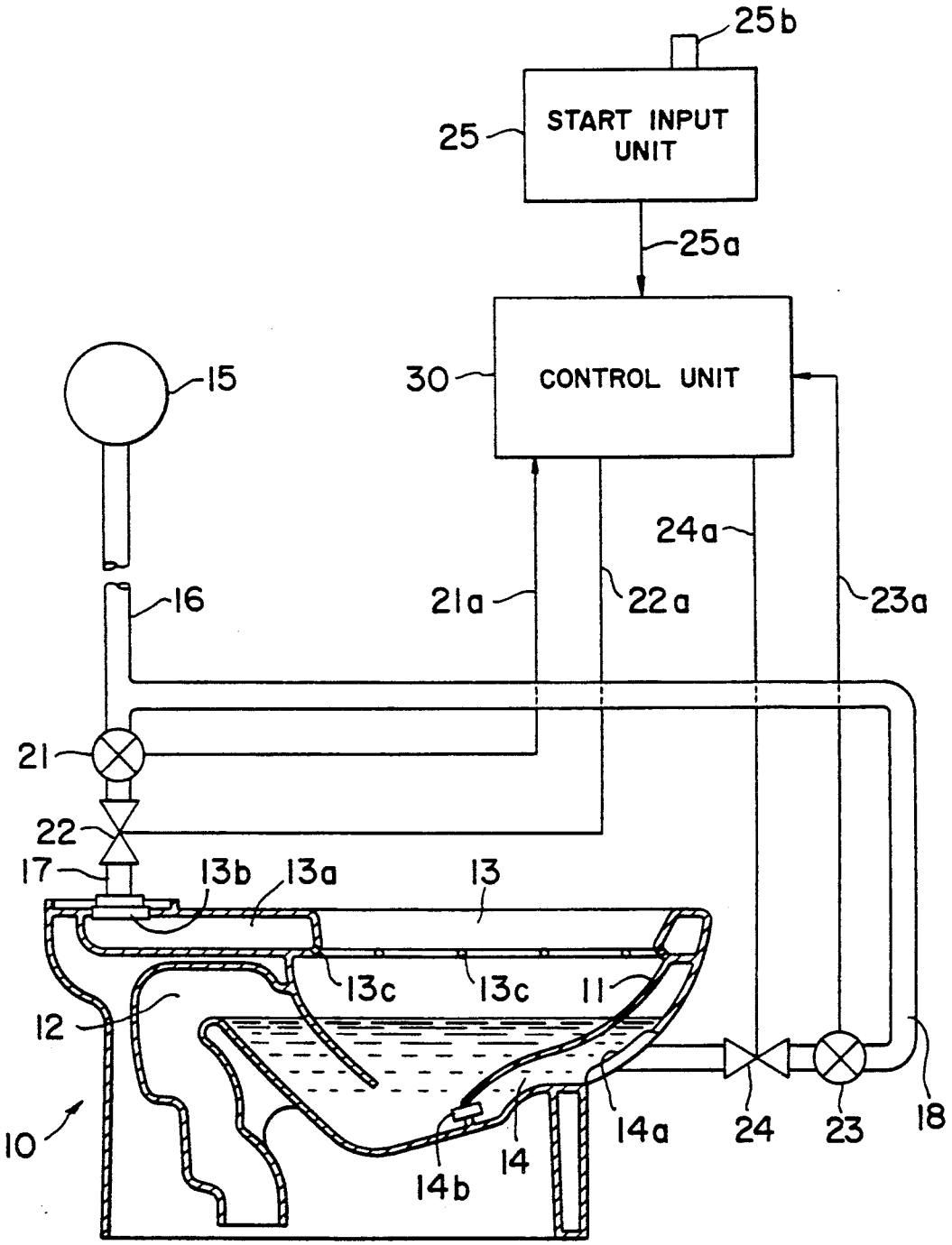
FIG. 1 is a block diagram of a first preferred embodiment of a W.C. flushing apparatus in accordance with the present invention illustrating a W.C. bowl in longitudinal section.
Figure 2:
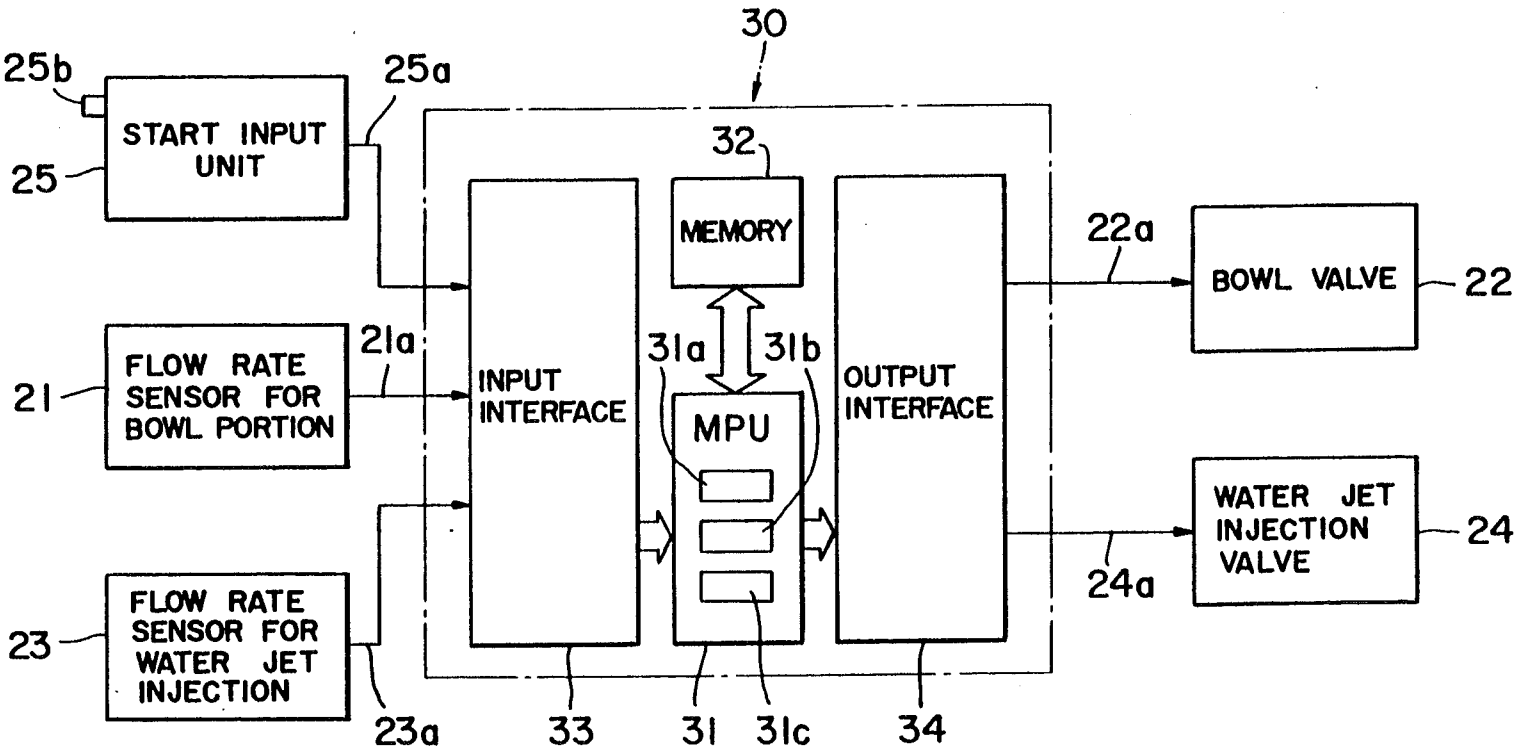
FIG. 2 is a block diagram illustrating the construction of a control unit of the first preferred embodiment shown in FIG. 1.

First Embodiment, FIGS. 1 and 2

Referring first to FIGS. 1 and 2, a first preferred embodiment of a W.C. flushing apparatus will be now described in detail hereinafter. A W.C. bowl generally indicated by a reference numeral 10 comprises a bowl portion 11 for receiving therein waste matter, a trap discharge passage 12 substantially in the form of an inverted U and communicated with the bottom of the bowl portion 11 and a rim portion 13 surrounding a circular upper edge of the bowl portion 11. The rim portion 13 is hollow as to define a flushing water flow passage 13*a*. One end of the flushing water flow passage 13*a* in the rim portion 13 is communicated with a flushing water feed port 13*b*. The rim portion 13*b* is formed with a plurality of feed ports 13*c* equiangularly spaced apart from each other and which are communicated with the flushing water flow passage 13*a*. These flushing water charging ports are designed to be inclined with respect to the inner wall surface of the bowl portion 11 and are in opposing relationship therewith. For instance, each of the flushing water charging ports 13*c* is inclined, for instance, at about 45° with respect to the horizontal direction so that the flushing water is injected downwardly at about 45° with respect to the horizontal direction. Therefore, the flushing water injected through the flushing water charging ports 13*c* into the bowl portion 11 produces a vortex flow therein.

The outer portion of the bowl portion 11 opposite to the portion thereof communicated with the trap discharge passage 12 defined a flushing water flow passage 14. One end of the flushing water flow passage 14 is communicated with a flushing water feed port 14*a* while the other end has a flushing water jet injection port 14*b*. It is preferable that the water jet injection port 14*b* is in the form of a flushing water injection nozzle so that the flushing water fed into the flushing water flow passage 14 may be injected toward the trap discharge passage in the form of an accelerated flushing water jet. The direction of the injection of flushing water emitted through the flushing water jet injection port 14*b* is so selected that the flushing water in the trap discharge passage encounters as low a resistance as possible. The injection direction is also selected depending upon the shape of the trap discharge passage 12.

A flushing water feed pipe 16 whose upper end is communicated with a flushing water supply source 15 is branched into a feed pipe 17 communicated with the bowl portion 11 and a feed pipe 18 communicated with the flushing water inlet port 14*a*. The feed pipe 17 is communicated through a flow rate sensor 21 and a solenoid controlled valve 22 with the inlet port 13*b* of the rim portion 13. The feed pipe 18 is communicated through a flow rate sensor 23 and a solenoid controlled valve 24 with the flushing water inlet port 14*a*.

The solenoid controlled valves 22 and 24 are connected through signal lines 22*a* and 24*a* , respectively, to a control unit 30 which transmits the control signals to the solenoid controlled valves 22 and 24 so that the valves 22 and 24 are opened or closed. The output signals from the flow rate sensors 21 and 23 are transmitted through signal lines 21*a* and 23*a*, respectively, to the control unit 30.

As shown in FIG. 2, the control unit 30 comprises .a microprocessor (MPU) 31, a memory 32, an input interface circuit 33 and an output interface circuit 34. The microprocessor 31 incorporates an integrator 31*a* for accumulating the quantity of flushing water in response to the output signals from the flow rate sensors 21 and 23 and a comparator 31*b* for comparing the quantity of flushing water accumulated by the accumulator 31*a* with a predetermined quantity of flushing water which is stored in the memory 32. An instruction process for transmitting the instruction signals to the solenoid controlled valves 22 and 24 so that the valves 22 and 24 are opened or closed independently of each other. Furthermore, the control unit 30 incorporates a timer 31*c* for controlling a time interval of each of the instruction signals to be transmitted to each of the solenoid controlled valves 22 and 24.

The signal lines 21*a* and 23*a* from the flow rate sensors 21 and 23 inserted into the feed lines 17 and 18, respectively are connected to the input interface circuit 33 of the control unit 30. Furthermore, a starting input unit 25 with a starting switch 25*b* is connected through a signal line 25*a* to the input interface circuit 33.

The output interface circuit 34 of the control unit 30 is connected through signal lines 22*a* and 24*a* to the solenoid controlled valves 22 and 24, respectively, inserted into the lines 17 and 18, respectively so that the "OPEN" or "CLOSE" signal is transmitted to the solenoid controlled valves 22 and 24.

Figure 3:
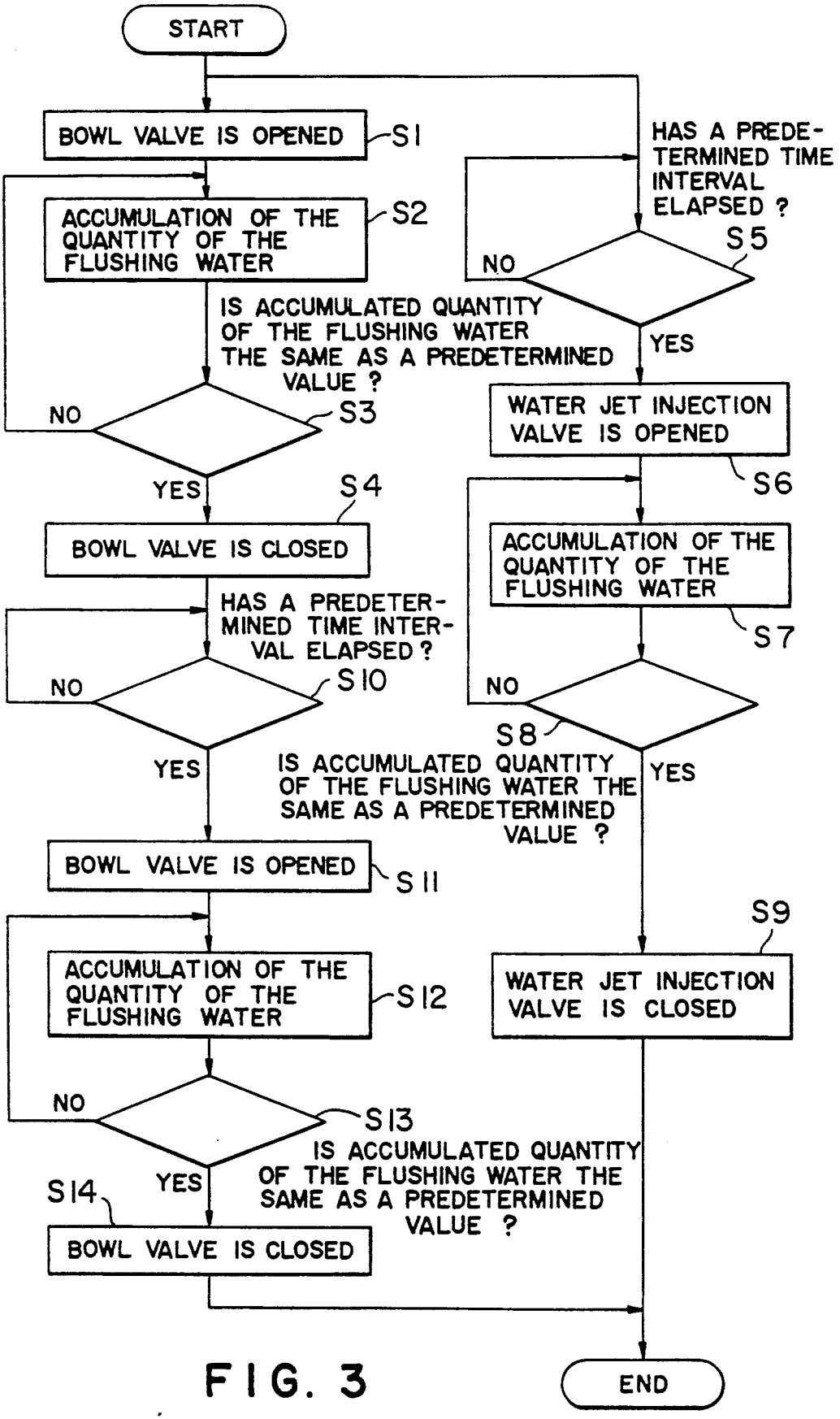
FIG. 3 is a flowchart illustrating a flushing water charging process in accordance with the present invention.

Referring next FIGS. 3 and 4, the mode of operation of the first preferred embodiment with the above-mentioned construction will be described hereinafter.

The starting switch 25*b* is turned on manually or automatically in response to the signal from a seat sensor or an optical sensor so as to start the operation of the W.C. flushing apparatus. The starting signal from the start input unit 25 is transmitted to the control unit 30 and then the microprocessor 31 transmits the "OPEN" signal to the solenoid controlled valve 22 (to be referred to as "the bowl valve" hereinafter in this specification). When the bowl valve 22 is opened, flushing water from the water supply source 15 is charged through the feed pipe 17 to the inlet port 13*b*. The flushing water charged into the flushing water flow passage 13*a* of the rim portion 13 is injected into the W.C. bowl 11 through the flushing water injection ports 13*c* and enters to produce a vortex flow within the bowl 11. The inside of the bowl 11 is therefore cleaned (Step $S_1$).

The quantity of the flushing water charged into the bowl 11 is detected by the flow rate sensor 21 and the signal representative of the quantity of flushing water charged into the bowl 11 is delivered to the accumulator 31*a* within the control unit 30 so that the quantity of flushing water charged into the bowl 11 is accumulated Step $S_2$). The accumulated quantity of flushing water charged into the bowl 11 is compared by the comparator 31*b* with a predetermined quantity of flushing water (Step $S_3$). When the quantity of flushing water charged into the bowl 11 reaches a predetermined quantity, the "CLOSE" signal is transmitted to the bowl valve 22 so that the latter is closed. The main cleaning operation for cleaning the inner wall surface of the bowl 11 is therefore accomplished.

The starting signal from the start input unit 25 is also delivered to the timer 31*c* in the control unit 30 so that the timer 31*c* starts counting a time interval (Step $S_5$). When the counted time interval is in excess of a predetermined value, the control unit 30 delivers the "OPEN" signal to the solenoid controlled valve 24 (to be referred to as "the water jet injection valve" hereinafter in this specification) so that the flushing water charged into the flushing water flow passage 14 through the inlet port 14*a* is forced to be injected in the form of a jet toward the trap discharge passage 12. As a result, the trap discharge passage 12 acts as a siphon so that waste matter and the standing water in the bowl 11 are discharged through the trap discharge passage 12 to the exterior. The quantity of flushing water for producing the above-mentioned siphon action is optimumly selected depending on the shape of the trap discharge passage 12 and the like and the quantity of flushing water jet to be injected into the bowl 11 toward the trap discharge passage 12 is controlled by the flow rate sensor 23. More specifically, as in the case of the control of the quantity of flushing water to be charged into the bowl 11 through the line 17, the quantity of flushing water is detected by the flow rate sensor 23 and is accumulated by the accumulator 31*a*. The accumulated quantity of flushing water is compared by the comparator 31*b* with a predetermined value (Steps $S_7$ and $S_8$). After a predetermined quantity of flushing water jet is injected through the injection port 14*b*, the injection valve is closed (Step $S_9$).

Figure 4:
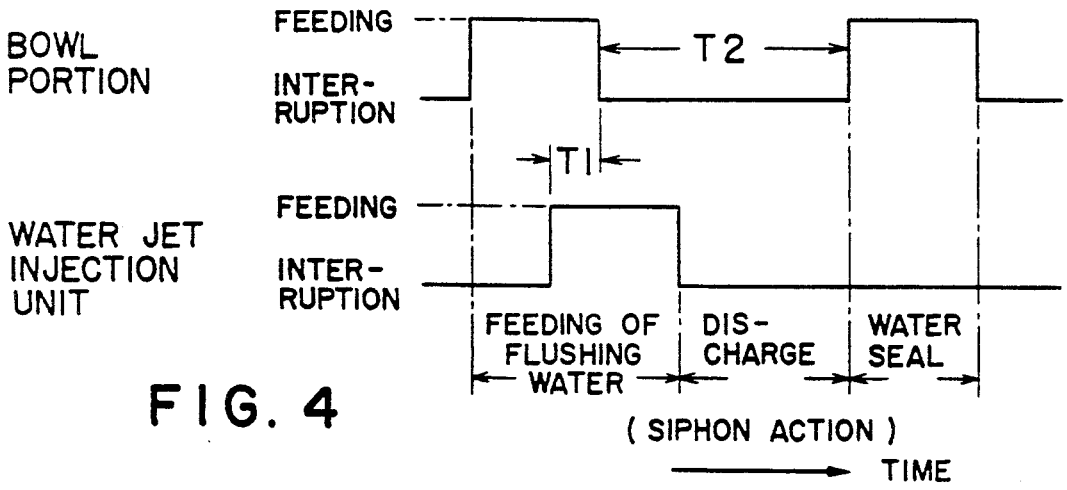
FIG. 4 is a time chart illustrating one mode of operation of a W.C. flushing apparatus in accordance with the present invention.

As shown in FIG. 4, the timing of opening the injection valve 24 may be determined while the bowl valve 22 is still opened Also as shown in FIG. 4, the flushing water is charged into the bowl 11 and the flushing water flow passage 14 during a time interval $T_1$. As a result, the air entrapped in the flushing water flow passage 14 can be previously discharged through the injection port 14*b* so that the injection of flushing water required to cause the trap discharge passage 12 to act as a siphon can be effectively accomplished. After a quantity of flushing water required for causing the trap discharge passage 12 to act as a siphon is injected, the injection valve 24 is closed. Waste matter within the bowl 11 is discharged by siphon action. A time interval of the discharge operation is controlled by the timer 31*c*. More particularly, when the bowl valve 22 is closed, the timer 31*c* starts counting a time interval (Step $S_{10}$) After a predetermined time interval (See FIG. 4) has elapsed, the "OPEN" signal is again delivered to the bowl valve 22 to open the same. Then the flushing water is charged into the bowl 11 and the quantity of flushing water charged into the bowl 11 is detected by the flow rate sensor 21 in a manner substantially similar to that described above and is accumulated by the accumulator 31 (Step $S_{12}$) The accumulated quantity of flushing water is compared by the comparator 31 with a predetermined value (Step $S_{13}$) and when the accumulated quantity of flushing water charged into the bowl 11 reaches a predetermined quantity, the bowl valve is closed (Step $S_{14}$). Thus, the flushing water is trapped inside the bowl until its surface level reaches a predetermined height. Thereafter the bowl valve 22 is closed so that one operation process of the W.C. flushing apparatus is accomplished.

As described above, the flushing water is injected in the form of a jet through the injection port 14*b* so that it becomes possible to fill water into the trap discharge passage 12 until water reaches the highest position thereof in a simple manner. As a result, only a small quantity of flushing water is needed to cause the trap discharge passage 12 to act as a siphon in an efficient manner. The quantity of the flushing water jet is detected by the flow rate sensor 21 and is controlled so that an optimum quantity of flushing water required for causing the trap discharge passage to act as a siphon can be selected. The "CLOSE" signal to be delivered to the bowl valve 22 and the injection valve 24 controlled upon the basis of the result of the accumulation of flushing water charged which is detected by the flow rate sensors 21 and 23 so that even when the pressure of flushing water in the water supply source 15 or the flushing water feed pipe 16, a predetermined quantity of flushing water can be charged all the time. As a result, the insufficient supply of flushing water can be avoided. Furthermore, the process in which waste matter is discharged after the completion of the cleaning the inside wall surface of the bowl 11 has been accomplished, is utilized so that even when the inside wall surface of the bowl 11 is much contaminated, it becomes possible to accomplish the satisfactory cleaning operation all the time.

Figure 5:
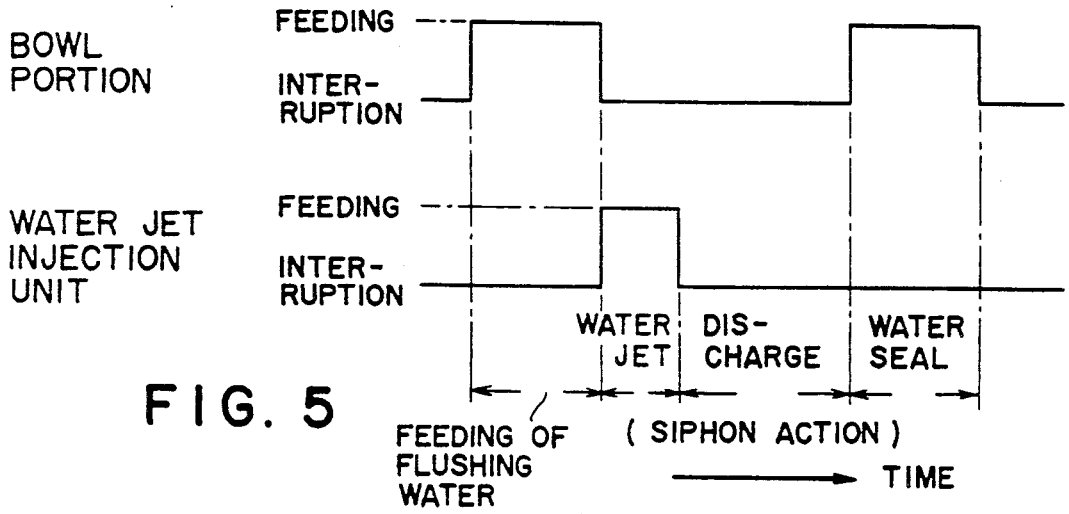
FIGS. 5 and 6 are time charts illustrating other modes of operation of a W.C. flushing apparatus in accordance with the present invention.

As shown in FIG. 4, in the case of the first preferred embodiment described above, described is the process that while the bowl valve 22 is still opened, the water jet injection valve 24 is opened successively so that the bowl cleaning operation and the flushing water jet injection are carried out at the same time. However, as shown in FIG. 5, the water jet injection valve 24 can be opened after the bowl valve 22 is closed. The "OPEN" signal applied to the water jet injection valve 24 may be not the signal generated by the timer 31*c*, but the water jet injection valve 24 may be opened in response to the "CLOSE" signal applied to the bowl valve 22.

Figure 6:
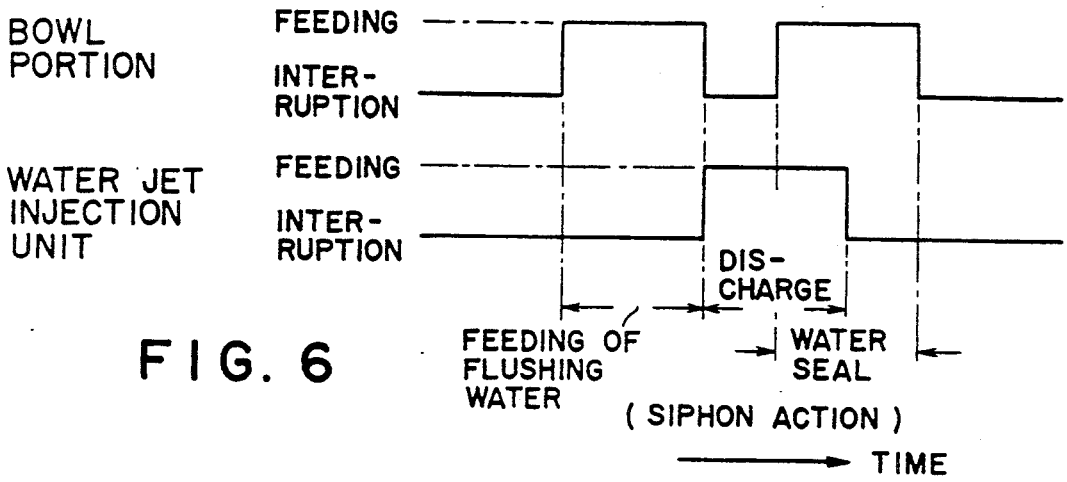

Furthermore, as shown in FIG. 6, the bowl valve 22 can be opened while the water jet injection valve 24 is still opened, thereby trapping a predetermined quantity of standing water in the bowl 11. Then, in response to the injection of flushing water jet through the injection port 14*b*, the siphon action is produced so that while waste matter is discharged, the water is charged into the bowl 11. As a result, the problem that the bowl 11 is emptied so that the intercommunication between the bowl 11 and the trap discharge passage 12 without both being filled with water can be avoided. Therefore the expansion of foul odors from the trap discharge passage 12 to the inside of the bowl 11 can be prevented and the generation of noise due to jet injection through the injection port 14*b* can be avoided.

Furthermore, as the flow rate sensors 21 and 23, a flowmeter of the type in which an impeller which is rotated in proportion to the flow rate and the rotation of the impeller per time unit is converted into the electrical signal may be used. In addition, it may be possible to use, as means for controlling the quantity of flushing water, means of the type in which a pressure gage is disposed in a flushing water feed pipe and in response to a pressure detected by the pressure gage, a timer operation time is controlled, thereby controlling an opened time interval of a solenoid controlled valve.

Figure 7:
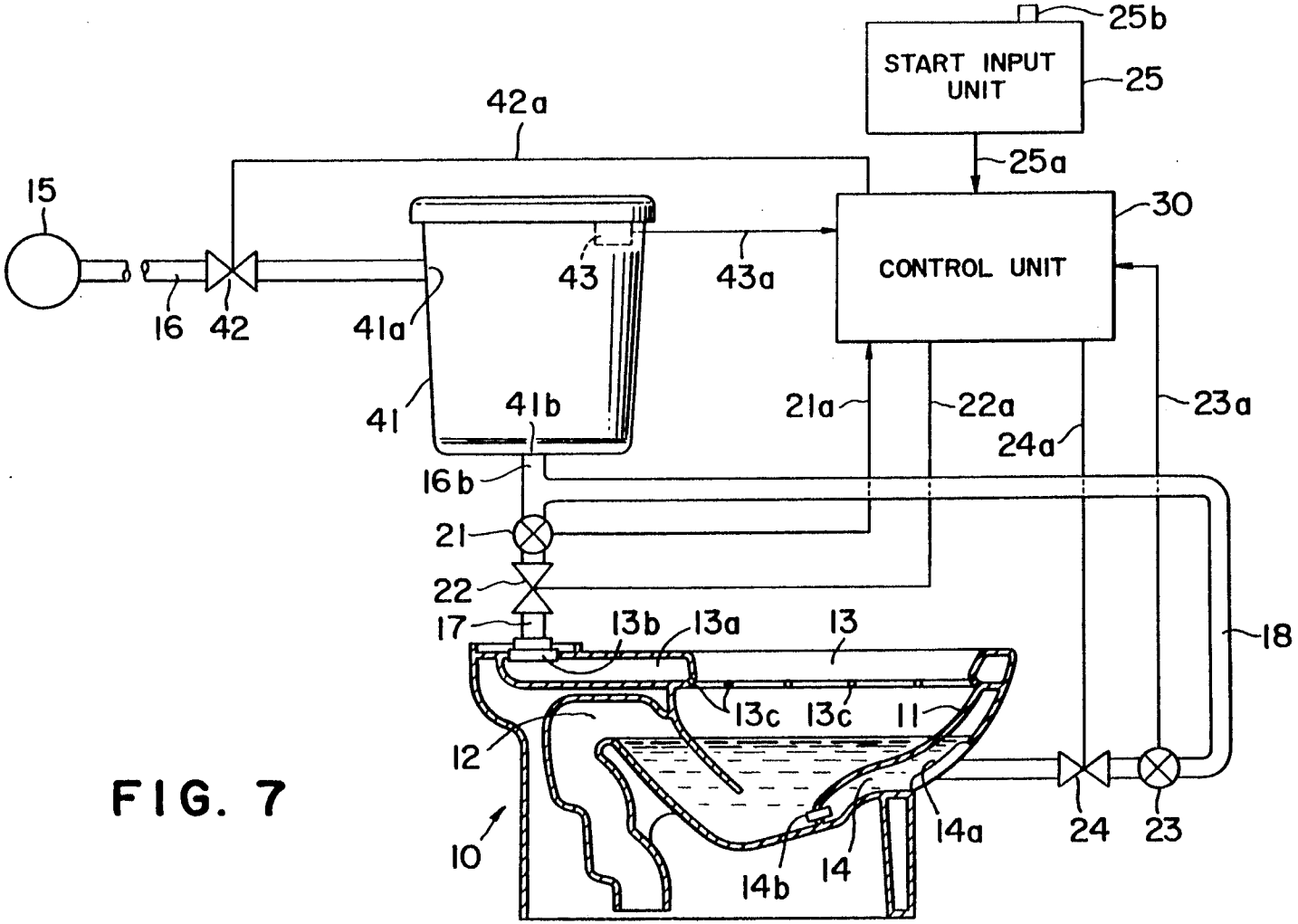
FIG. 7 is a block diagram of a second preferred embodiment of a W.C. flushing apparatus in accordance with the present invention with a W.C. bowl being illustrated in longitudinal section.

Second Embodiment, FIG. 7

FIG. 7 is a view similar to FIG. 1 but illustrates a second preferred embodiment of a W.C. flushing apparatus in accordance with the present invention. The second embodiment is substantially similar to the first preferred embodiment described above with reference to FIGS. 1 and 2 except that the flushing water supply source 15 is provided with a flushing water storage tank 41 so that other component parts similar to those of the first preferred embodiment will not be further explained.

One end of a flushing water feed line 16 is communicated with the flushing water supply source 15 while the other end, with an inlet port 41*a* of the storage tank 41 so that the flushing water is temporarily stored in the storage tank 41 before the flushing operation. A solenoid controlled valve 42 is inserted into the feed line upstream of the inlet port 41*a*. A surface level sensor 43 is disposed at a predetermined upper portion within the storage tank 41 so as to measure the surface level of flushing water stored therein. As a surface level sensor, it is possible to use a liquid-level measuring means of the type in which a time interval between the time when the light beam or the ultrasonic waves are emitted and the time when they are reflected and then received is computed, thereby measuring the liquid level. The flushing water feed line 16*a* which is communicated with the outlet port 41*b* branched into the bowl feed line 17 and the flushing water jet feed pipe 18.

The solenoid controlled valve 42 is electrically connected through a signal line 42*a* and the output interface 34 (See FIG. 2) to the microprocessor 31 in the control unit 30. The liquid-level sensor 43 is connected through a signal line 43*a* and the input interface circuit 33 to the microprocessor 31 in the control unit 30.

Next the mode of operation of the second embodiment with the above-mentioned construction will be described hereinafter. When the starting switch 25*b* is turned on, the start input unit 15 delivers the starting signal to the control unit 30 so that, as in the case of the first embodiment described above with reference to FIG. 1, the process of charging the flushing water into the W.C. bowl 10, cleaning of the inner wall surface of the bowl portion 11 and discharging waste matter through the trap discharge passage 12 is carried out. In this process, the liquid level of the flushing water stored in the storage tank 41 is lowered because the flushing water is fed from the storage tank 41 through the outlet 41*b* to the feed line 16*b*.

When the above-mentioned flushing process is accomplished, the "OPEN" signal is transmitted to the solenoid-controlled valve 42 to open the same so that the flushing water is supplied from the flushing water supply source 16 into the storage tank 41. When the liquid level of the flushing water in the storage tank rises and is detected to have reached to a predetermined height by the liquid-level sensor 43, the solenoid controlled valve 42 is closed so that the supply of the flushing water into the storage tank 41 is interrupted.

As described above, the second embodiment is further provided with the flushing water storage tank 41 so that it becomes possible to control the quantity of flushing water required for one flushing process in a stable manner. Therefore, even when the pressure of flushing water supplied from the water source 15 varies, it is possible to obtain the flushing water at a predetermined pressure for charging into the bowl portion 11 and injecting into the trap discharge passage 12.

Third Embodiment, FIGS. 8 and 9

Next referring to FIGS. 8 and 9, the third preferred embodiment of a W.C. flushing apparatus in accordance with the present invention will be described.

A W.C. bowl generally indicated by the reference number 50 comprises a bowl portion 51 for receiving therein waste matter and a trap discharge passage 53 which is separated from the bowl portion 51 by a partition wall 52, communicated with the bottom of the bowl portion 51 and is substantially in the form of an inverted U. A circular rim portion 54 is defined at the upper edge of the bowl portion 51 and is hollow to define a flushing water flow passage 54. The flow passage **54*a* is enlarged in cross sectional area partially over a predetermined length so as to define a flushing water feed chamber 54*b* which is communicated with a flushing water inlet port 54*c*. The flow passage 54*a* is formed with a plurality of flushing water charging ports 54*d* which are inclined in such a way that the direction in which the flushing water charged into the bowl portion 51 is directed downwardly at about 45° with respect to the horizontal toward the inner wall surface of the bowl portion 51. As a result, charged flushing water produces a spiral flow within the bowl portion 51** so that the flushing efficiency can be improved.

A downstream discharge passage **53*a* of the trap discharge passage 53 downstream of a weir portion 53*b* is substantially in the form of a vertical tube. A cylindrical water sealing generating mechanism 55 is securely attached to the downstream end of the discharge passage 53*a*. The water seal generating mechanism is in the form of a synthetic resin cylinder and has an enlarged diameter portion 55*a* extended substantially from the midpoint of the discharge passage 53*a* to the downstream end and a waste matter guide cylinder 55*b* disposed within the enlarged diameter portion 55*a* coaxially thereof. The downstream end of the discharge passage 55*a* is bent radially inwardly so as to define a flange 55*c* which in turn defines a reduced-diameter discharge opening 56. The upper portion of the enlarged diameter cylinder 55*a* is defined as a connecting cylindrical portion 55*d* which in turn is water-tightly fitted over and bonded to the downstream portion of the discharge passage 53*a*** with an adhesive.

As best shown in FIG. 9, the enlarged diameter cylindrical portion **55*a* and the waste matter guide cylinder 55*b* are connected to each other by connecting members 55*e*. Arcuate spaces 57*a* are defined between the inner surface of the enlarged diameter cylindrical portion 55*a* and the outer cylindrical surface of the waste matter guide cylinder 55*b* while a space 57*b* is also defined between the lower end of the waste matter guide tube 55*b* and the upper surface of the flange 55*c* as shown in FIGS. 8 and 9. Furthermore, a space 57*c* is defined between the inner wall of the enlarged diameter cylindrical portion 55*a* and the upper end of the waste matter guide cylinder 55*b***.

A cover 59 is provided on the upstream side of the water chamber **54*b* to define an equipment compartment in which is housed a control equipment for the W.C. flushing apparatus. A flushing water feed line 61 is extended through the cover 59 and communicated with the flushing water supply source 15. The feed line 61 branches to a line 62 for charging the flushing water into the bowl portion 51, and a line 63 for feeding the flushing water which is injected into the trap discharge passage 53. The feed line 62 is communicated through a solenoid controlled valve 64 (to be referred to as "the bowl valve" hereinafter in this specification), a vacuum breaker 65 and a flow rate sensor 66 in the order named with an inlet port 54*c***.

In like manner, the feed line 63 is communicated through a solenoid controlled valve 67 (to be referred to as "the jet valve"), a vacuum breaker 68 and a flow rate sensor 69 in the order named with a jet injection unit.

The jet injection unit has a jet injection nozzle 71 which is disposed at the deepest position of the bowl portion 51 and whose nozzle hole **71*a* is directed toward an inlet opening 53*c* of the trap discharge passage 53. The jet injection nozzle 71 is made of a metal or a synthetic resin and is in the form of a "U". In the third embodiment, the feed line 63 is extended along the outer surface of the W.C. bowl 50 and is directly communicated with an inlet port 71*b* of the jet injection nozzle 71**.

Housed within the equipment compartment 58 is a control unit 72 connected, as in the case of the first or second embodiment, through signal lines to the bowl and jet valves 64 and 67 and to the flow rate sensors 66 and 69. A start input unit 73 which has various switches for operating the flushing water supply device or a sensor for generating the starting signal is connected to the control unit 72.

The flushing process of the third embodiment with the above-mentioned construction is substantially similar to that of the first or second preferred embodiment so that the features of the third embodiment only will be described.

First, the feed line 63 is directly communicated with the jet injection nozzle 71 without flowing other lines so that the resistance to the flushing water flowing from the flushing water supply source 15 to the nozzle 71 is low and therefore unwanted pressure drop can be avoided. As a result, even if the pressure of flushing water supplied from the water supply source 15 is relatively low, it becomes possible to charge the flushing water to the trap discharge passage 53 so that the latter is caused to act as a siphon. Furthermore, the kinetic energy of the water jet injected through the nozzle 71 so that the air entrapped in the trap discharge passage 53 can be discharged within a short time, thereby starting the siphon action. As described above, the siphon action can be efficiently produced so that the quantity of flushing water can be decreased.

In the third embodiment, the water seal generating mechanism 55 is disposed at the lower end of the trap discharge passage 53. It follows therefore that part of the waste matter flowing in the downstream side discharge passage passes through the space **57*c*, 57*a* and 57*b* defined between the enlarged-diameter portion 55 and the waste matter guide cylinder 55*b* and is discharged through the discharge opening 56. The discharge opening 56 defines a restriction or restrictor because the flange 55*c* is radially inwardly extended so that waste matter which flows radially inwardly through the space 57b defined between the lower end of the waste matter guide cylinder 56b and the upper surface of the flange 55c produces a water seal at the discharge opening. (That is, the discharge opening 56 is covered with a water film.) Because of this water seal phenomenon, the interior of the trap discharge passage 53 is sealed from the surrounding atmosphere and the flushing water fills the trap discharge passage 53 upstream of the water seal. As a result, the air entrapped in the trap discharge passage 53 is quickly and positively discharged together with waste matter through the discharge opening 56 so that it becomes easy to cause the trap discharge passage 53** to fully act as a siphon.

In the first, second and third embodiments described above, the quantity of the flushing water distributed into the feed line 17 for charging the flushing water into the bowl portion and the feed line 18 communicated with the water jet injection port in response to the accumulated quantity obtained from the quantity of flushing water detected by the flow rate sensors 21 and 23. However, it is to be understood that the method for controlling the quantity of flushing water charged into the bowl portion and the trap discharge passage is not limited to the above-mentioned method only and the quantity of flushed water can be controlled in response to a time interval determined by the detection of the instantaneous flow rates of the flushing water flowing through the feed lines 17 and 18, respectively. A fourth preferred embodiment employing the latter method will be described hereinafter.

Figure 10:
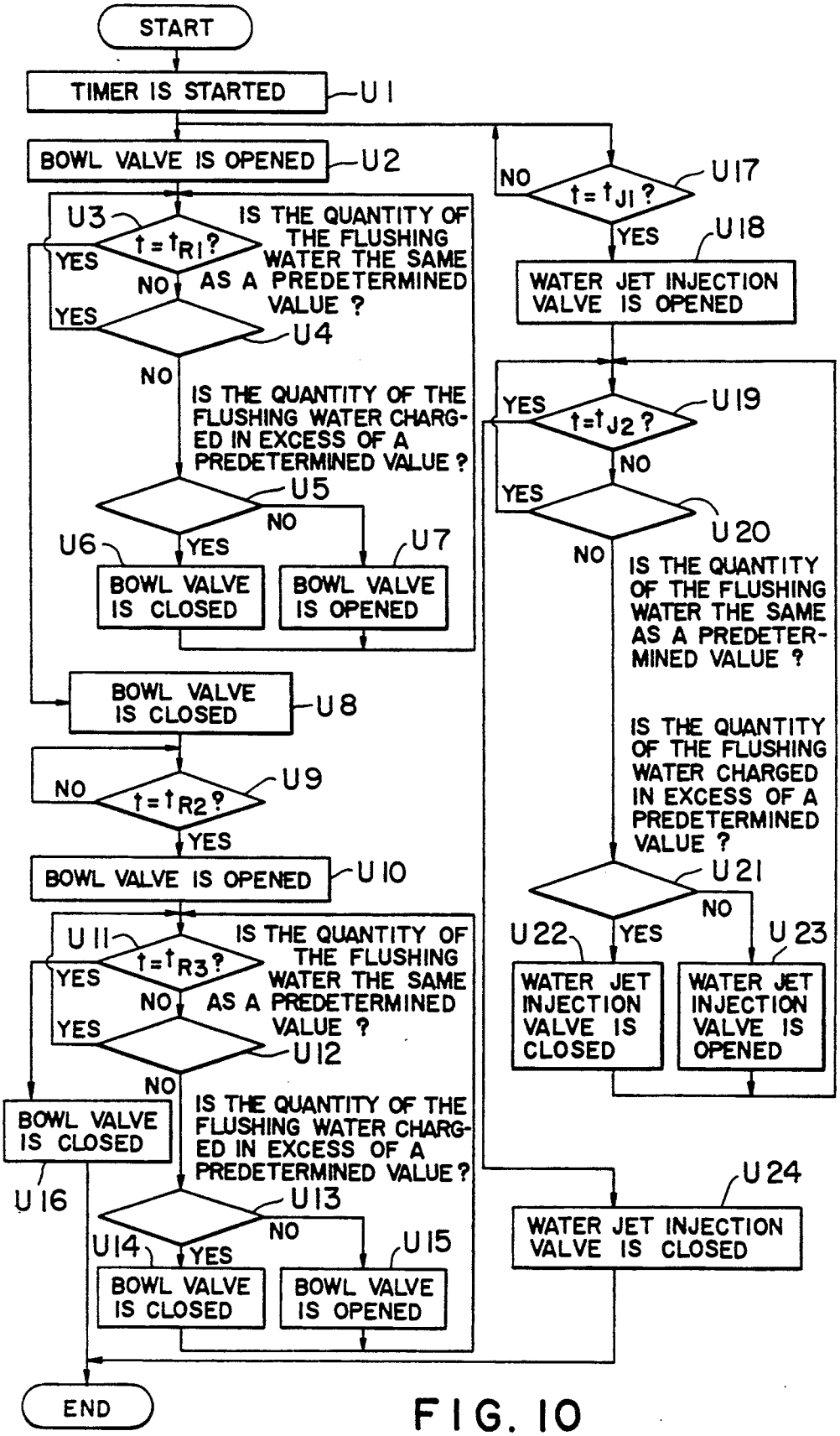
FIG. 10 is a flowchart illustrating the mode of operation of a fourth preferred embodiment of a W.C. flushing apparatus in accordance with the present invention.
Figure 11:
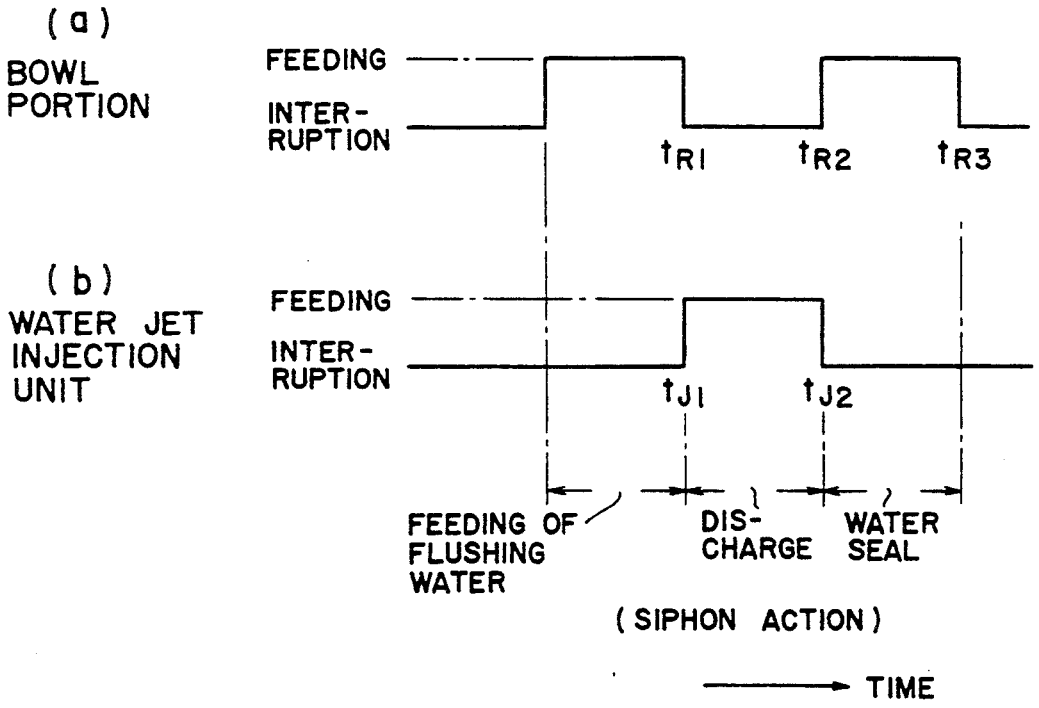
FIG. 11 is a time chart illustrating the mode of operation of the fourth preferred embodiment.

Fourth Embodiment, FIGS. 10 and 11

The fourth embodiment is substantially similar in construction to those of the first, second or third embodiments described above, except for a control program for the control unit 30, but it is preferable that as the bowl valve 22 and the jet injection valve 24, the valves capable of controlling the flow rates at a high degree of accuracy. For instance, it is preferable to use piezoelectric actuators each capable of controlling the stepless opening operation or closing operation.

Now the fourth embodiment will be described in detail with reference to FIGS. 10 and 11 illustrating the flowchart and the time chart, respectively.

When the starting switch 25b is turned on, the counter 31c starts counting a time interval (Step $U_1$). Next in response to the command signal from the microprocessor 31, the bowl valve 22 is opened (Step $U_2$) so that the flushing water is charged into the feed line 17. The signal representative of the flow rate generated by the flow rate sensor 21 is delivered to the comparator 31b in the control unit 30 so as to be compared with a predetermined instantaneous flow rate (Step $U_4$, $U_5$). When the detected instantaneous flow rate is in excess of a predetermined value, the bowl valve 22 is slightly closed (Step $U_6$). On the other hand, when the detected instantaneous flow rate is lower than a predetermined value, the bowl valve 22 is slightly opened (Step $U_7$). The opening or closing operation of the bowl valve 22 is controlled in the manner just described above so that the instantaneous flow rate of the flushing water fed to the flushing water feed line 17 may be maintained substantially constant and the step for charging the flushing water into the bowl portion 11 is continued. When the time interval counted by the timer 31c reaches a predetermined time interval $T_{R3}$ (Step $U_3$), the bowl valve 22 is tightly and completely closed (Step $U_8$).

Meanwhile when a time interval counted by the timer 31c reaches a predetermined time interval $T_{JL}$ ($=T_{R1}$ in the time chart shown in FIG. 11) (Step $U_{17}$), the jet injection valve 24 is opened (Step $U_{18}$) so that the flushing water flows through the feed line 18 and the flushing water jet is injected through the jet injection port 16b.

The signal representing the flow rate generated by and delivered from the flow rate sensor 23 is applied to the comparator in the control unit 30 so as to be compared with a predetermined instantaneous flow rate (Steps $U_{20}$ and $U_{21}$). In response to the result of the comparison, the degree of opening of the jet injection valve 24 is controlled in such a way that the flow rate of the flushing water flowing through the feed line 18 may be maintained substantially constant (Steps $U_{22}$ and $U_{23}$).

Until the time interval counted by the timer 31c coincides with a predetermined time interval $T_{J2}$, the feed of the flushing water to the water jet injection port 14b is continued so that the trap discharge passage 12 is caused to act as a siphon. When the time interval counted by the timer 31c coincides with a predetermined time interval $T_{J2}$ (Step $U_{19}$), the water jet injection Valve 24 is completely closed so that the water jet injection is interrupted (Step $U_{24}$).

When the time interval counted by the timer 31c coincides with a predetermined time interval $T_{R2}$ ($=T_{J2}$ in the time chart shown in FIG. 11) (Step $U_9$), the bowl valve 22 is opened again (Step $U_{10}$). The bowl valve 22 remains opened until the time interval counted by the timer 31c coincides with a predetermined time interval $T_{R3}$. When the above-described steps are being carried Out, in response to the result of the comparison between the instantaneous flow rate detected by the flow rate sensor 21, the degree of the opening of the bowl valve 22 is controlled (Steps $U_{12}$, $U_{13}$, $U_{14}$ and $U_{15}$) so that the flow rate flowing through the feed line 17 is maintained substantially constant and the bowl portion 11 is water-sealed.

When the time interval counted by the timer 31c coincides with a predetermined time interval $T_{R3}$ (Step $U_{11}$), the bowl valve 22 is completely closed (Step $U_{16}$). One flushing operation is therefore accomplished.

Instead of the time chart for the fourth embodiment, it is possible to use the time charts shown in FIGS. 4, 5 and 6.

As described above, according to the present invention, effective flushing operation can be accomplished with a relatively small quantity of flushing water.

Although specific embodiments of the present invention have been described in detail herein, modifications and changes may be made therein without departing from the scope of the present invention as defined in the appended claims.

What is claimed is:

1. A water closet flushing apparatus comprising a bowl portion provided with a flushing water inlet port;

a trap discharge passage defined adjacent to the bottom portion of said bowl portion;

a flushing water supply source;

a first flow passage means connecting said flushing water supply source to said flushing water inlet port;

a water jet injection means for injecting a flushing water jet toward said trap discharge passage;

a second flow passage means connecting said flushing water supply source to said water jet injection means;

a first electrical opening and closing means which is disposed within said first flow passage means for opening and closing said first flow passage means in response to receipt by said first opening and closing means of "open" or "close" signals, respectively;

a second electrical opening and closing means which is disposed within said second flow passage means for opening and closing said flow passage means in response to receipt by said second opening and closing means of "open" and "close" signals, respectively; flow rate sensor means for detecting the flow rates of the flushing water flowing through said first and second flow passage means, respectively, and for generating output signals indicative of the detected flow rates;

a control means for delivering said "open" and "close" signals according to a predetermined program to said first and second opening and closing means, respectively, for supplying a predetermined quantity of flushing water to said first and second flow passage means, respectively, in a predetermined sequence during each cycle of operation of said flushing apparatus, and means for applying a start signal to said control means for beginning each cycle of operation of the apparatus.

2. A water closet flushing apparatus as defined in claim 1 in which said flow rate sensor means are disposed both in said first and second flow passage means, respectively.

3. A water closet flushing apparatus as defined in claim 2 in which said control means comprises a flushing water quantity accumulation means for accumulating the flushing water quantity in response to said output signals from said accumulation means and comparator means for comparing the quantity of the flushing water accumulated by said flow rate sensor means with a predetermined quantity.

4. A water closet flushing apparatus as defined in claim 2 in which, in response to said output signals generated by said sensor means, said control means controls said first and second opening and closing means for maintaining substantially constant the instantaneous flow rates of flushing water flowing through said first opening and closing means and said second opening and closing means.

5. A water closet flushing apparatus as defined in claim 2 in which said control means is provided with a storage means for storing command information for delivering and interrupting said open and/or close signals.

6. A water closet flushing apparatus as defined in claim 1 in which said flushing water supply source is provided with a flushing water storage tank having a liquid-level measuring means.

7. A flushing method for a water closet comprising a bowl portion and a trap discharge passage, comprising the steps of a. flushing water into said bowl portion, thereby cleaning the same, while measuring the quantity of water flushed into said bowl, and shutting off the flow of water when a predetermined quantity of water has flowed into said bowl;

b. injecting a flushing water jet into said trap discharge passage so that said trap discharge passage is caused to act as a siphon, thereby discharging waste matter including the flushed water, while measuring the quantity of water jetted into said trap discharge passage, and shutting off the flow of water when a predetermined quantity of water has jetted into said trap discharge passage; and c. feeding flushing water into said bowl portion, thereby water sealing the same, while measuring the quantity of water fed into said bowl, and shutting off the feed of water when a preselected quantity of water has been fed.

8. A flushing method as defined in claim 7 in which the water jet injection into said trap discharge passage is carried out after the flushing water is flushed into said bowl portion.

9. A flushing method as defined in claim 7 in which the injection of the water jet into said trap discharge passage is carried out while the flushing water is being flushed into said bowl portion.

10. A flushing method as defined in claim 9 in which the water sealing of said bowl portion is effected while the flushing water is injected into said trap discharge passage.

11. A flushing method as defined in claim 7 in which the water flushed into said bowl portion is caused to produce a vortex flow over the inner surface of said bowl.

12. A flushing method as defined in claim 7 in which the quantity of the flushing water flushed and injected is controlled in response to the output signals from flow rate sensor means.

* * * * *